US010006701B2

(12) United States Patent
Mak

(10) Patent No.: US 10,006,701 B2
(45) Date of Patent: Jun. 26, 2018

(54) ETHANE RECOVERY OR ETHANE REJECTION OPERATION

(71) Applicant: Fluor Technologies Corporation, Sugar Land, TX (US)

(72) Inventor: John Mak, Santa Ana, CA (US)

(73) Assignee: Fluor Technologies Corporation, Sugar Land, TX (US)

( * ) Notice: Subject to any disclaimer, the term of this patent is extended or adjusted under 35 U.S.C. 154(b) by 68 days.

(21) Appl. No.: 14/988,388

(22) Filed: Jan. 5, 2016

(65) Prior Publication Data

US 2017/0191753 A1 Jul. 6, 2017

(51) Int. Cl.
*F25J 3/06* (2006.01)
*F25J 3/02* (2006.01)

(52) U.S. Cl.
CPC ..... *F25J 3/064* (2013.01); *F25J 3/0233* (2013.01); *F25J 3/0238* (2013.01); *F25J 3/0615* (2013.01); *F25J 3/0695* (2013.01)

(58) Field of Classification Search
CPC ..... F25J 3/0233; F25J 3/0238; F25J 3/064; F25J 3/0635; F25J 2215/62
See application file for complete search history.

(56) References Cited

U.S. PATENT DOCUMENTS 4,617,039 A 10/1986 Buck
5,555,748 A 9/1996 Campbell et al.
6,601,406 B1 8/2003 Deng et al.
6,837,070 B2 1/2005 Mak
6,915,662 B2 7/2005 Wilkinson et al.
7,051,552 B2 5/2006 Mak
7,051,553 B2 5/2006 Mak et al.
7,073,350 B2 7/2006 Mak
7,192,468 B2 3/2007 Mak et al.
7,377,127 B2 5/2008 Mak
7,424,808 B2 9/2008 Mak
7,574,856 B2 8/2009 Mak
7,597,746 B2 10/2009 Mak et al.
7,600,396 B2 10/2009 Mak
7,635,408 B2 12/2009 Mak et al.
7,637,987 B2 12/2009 Mak
7,674,444 B2 3/2010 Mak
(Continued)

FOREIGN PATENT DOCUMENTS

WO 2017119913 A1 7/2017

OTHER PUBLICATIONS

PCT Application No. PCT/US2016/013687, International Search Report and Written Opinion, dated Aug. 24, 2016, 12 pages.

*Primary Examiner* — Brian King
(74) *Attorney, Agent, or Firm* — Conley Rose, P.C.

(57) ABSTRACT

A method for operating a natural gas liquids processing (NGL) system, the system being selectively configured in either an ethane rejection configuration or an ethane recovery configuration, the method comprising, when the NGL system is in the ethane rejection configuration, collecting a reboiler bottom stream that, in the ethane rejection configuration, includes ethane in an amount of less than 5% by volume, and when the NGL system is in the ethane recovery configuration, collecting a reboiler bottom stream that, in the ethane recovery configuration, includes ethane in an amount of at least about 30% by volume.

21 Claims, 3 Drawing Sheets

(56) References Cited

U.S. PATENT DOCUMENTS

| | | | | |
|---|---|---|---|---|
| 7,713,497 | B2 | 5/2010 | Mak | |
| 7,785,480 | B2 | 8/2010 | Mak et al. | |
| 7,856,847 | B2 | 12/2010 | Patel et al. | |
| 7,980,081 | B2 | 7/2011 | Mak | |
| 8,065,890 | B2 | 11/2011 | Mak | |
| 8,110,023 | B2 | 2/2012 | Mak et al. | |
| 8,117,852 | B2 | 2/2012 | Mak | |
| 8,142,648 | B2 | 3/2012 | Mak | |
| 8,147,787 | B2 | 4/2012 | Mak et al. | |
| 8,192,588 | B2 | 6/2012 | Mak | |
| 8,196,413 | B2 | 6/2012 | Mak | |
| 8,209,996 | B2 | 7/2012 | Mak | |
| 8,316,665 | B2 | 11/2012 | Mak | |
| 8,377,403 | B2 | 2/2013 | Mak | |
| 8,398,748 | B2 | 3/2013 | Mak | |
| 8,480,982 | B2 | 7/2013 | Mak et al. | |
| 8,505,312 | B2 | 8/2013 | Mak | |
| 8,567,213 | B2 | 10/2013 | Mak | |
| 8,635,885 | B2 | 1/2014 | Mak | |
| 8,661,820 | B2 | 3/2014 | Mak | |
| 8,677,780 | B2 | 3/2014 | Mak | |
| 8,695,376 | B2 | 4/2014 | Mak | |
| 8,696,798 | B2 | 4/2014 | Mak | |
| 8,826,673 | B2 | 9/2014 | Mak | |
| 8,840,707 | B2 | 9/2014 | Mak | |
| 8,845,788 | B2 | 9/2014 | Mak | |
| 8,876,951 | B2 | 11/2014 | Mak | |
| 8,893,515 | B2 | 11/2014 | Mak | |
| 8,910,495 | B2 | 12/2014 | Mak | |
| 8,919,148 | B2 | 12/2014 | Wilkinson et al. | |
| 8,950,196 | B2 | 2/2015 | Mak | |
| 9,103,585 | B2 | 8/2015 | Mak | |
| 9,114,351 | B2 | 8/2015 | Mak | |
| 9,132,379 | B2 | 9/2015 | Mak | |
| 9,248,398 | B2 | 2/2016 | Mak | |
| 2004/0250569 | A1 | 12/2004 | Mak | |
| 2005/0255012 | A1 | 11/2005 | Mak | |
| 2010/0275647 | A1* | 11/2010 | Johnke | C10G 5/06 62/620 |
| 2010/0287984 | A1* | 11/2010 | Johnke | F25J 3/0209 62/620 |
| 2012/0096896 | A1* | 4/2012 | Patel | F25J 3/0214 62/620 |
| 2014/0026615 | A1 | 1/2014 | Mak | |
| 2014/0260420 | A1* | 9/2014 | Mak | F25J 3/0209 62/620 |
| 2015/0184931 | A1 | 7/2015 | Mak | |

* cited by examiner

ETHANE RECOVERY OR ETHANE REJECTION OPERATION

FIELD OF INVENTION

The subject matter disclosed herein relates to systems and methods for processing natural gas. More particularly, the subject matter disclosed herein relates to systems and methods for selectively recovering or rejecting ethane during the natural gas processing, particularly, processing of unconventional gas and shale gas.

BACKGROUND

Natural gas is produced from various geological formations. Natural gas produced from geological formations typically contains methane, ethane, propane, and heavier hydrocarbons, as well as trace amounts of various other gases such as nitrogen, carbon dioxide, and hydrogen sulfide. The various proportions of methane, ethane, propane, and the heavier hydrocarbons may vary, for example, depending upon the geological formation from which the natural gas is produced.

For example, natural gas produced from conventional geological formations, such as reservoir rock formations, may comprise about 70-90% methane and about 3-9% ethane, with the remainder being propane, heavier hydrocarbons, and trace amounts of various other gases (nitrogen, carbon dioxide, and hydrogen sulfide). Such conventionally-produced natural gases may be termed "lean," meaning that this natural gas contains from about 2 to about 4 gallons of ethane per thousand standard cubic feet of gas (GPM).

Conversely, natural gas from unconventional geological formations, such as coal seams, geo-pressurized aquifers, and shale formations, may comprise about 70-80% methane and about 10-25% ethane, with the remainder being propane, heavier hydrocarbons, and trace amounts of various other gases (nitrogen, carbon dioxide, and hydrogen sulfide). Such non-conventionally-produced natural gases may be termed "rich," having 8-12 GPM.

During natural gas processing, the natural gas produced from a geological formation (e.g., the "feed gas") is generally separated into two product streams: a natural gas liquids (NGL) stream and a residue gas stream. In some circumstances, it may be desirable that the ethane within the feed gas stream is separated into the resulting NGL stream (referred to as an "ethane recovery" configuration). Alternatively, it may be desirable that the ethane within the feed gas is separated into the resulting residue gas stream (referred to as an "ethane rejection" configuration).

Conventional natural gas separation systems and methods are generally designed and built to be operated so as to recover ethane as a component of the NGL stream. As such, operating a conventional natural gas processing system or method such that ethane is rejected, that is, so that ethane is present in the residue gas stream, is outside the design parameters upon which such conventional systems and methods are based, resulting in decreases in operational efficiency.

Further, conventional natural gas separation systems and methods are also generally designed and built to be operated within relatively narrow ranges of parameters, for example, as to feed gas composition and throughput rate. Operating such a conventional natural gas processing system or method outside of these parameters (for example, by processing natural gases having a composition other than the range of composition for which the system/method was designed and built and/or processing natural gas at a throughput rate other than the rate for which the system/method was designed and built) may be so inefficient as to be economically undesirable or, may be impossible because of system limitations.

As such, what is needed are cost effective systems and methods for processing natural gas (i) that may be used to selectively recover or reject ethane, (ii) that may be used to process natural gas having variable composition (e.g., natural gas from conventional or non-conventional geological formations), and (iii) that may be used to process natural gas at a wide range of throughput flow-rates, while achieving high propane recovery, particularly during ethane rejection.

SUMMARY

Disclosed herein is a method for operating a natural gas liquids processing (NGL) system, the system being selectively configured in either an ethane rejection configuration or an ethane recovery configuration, the method comprising cooling a feed stream comprising methane, ethane, and propane in a heat exchanger to yield a chilled feed stream, introducing the chilled feed stream into a separation vessel having a first portion, a second portion, and a third portion, wherein the chilled feed stream is introduced into the first portion of the separation vessel, and when the NGL system is in the ethane rejection configuration heating a first portion bottom stream in the heat exchanger to yield a heated first portion bottom stream, introducing the heated first portion bottom stream into the second portion of the separation vessel, introducing a first portion overhead stream into the third portion of the separation vessel, introducing a third portion bottom stream into the second portion, heating a third portion overhead stream in the heat exchanger, wherein in the ethane rejection configuration the third portion overhead stream comprises ethane in an amount of at least about 5% by volume, introducing a second portion bottom stream into a reboiler, and collecting a reboiler bottom stream, wherein in the ethane rejection configuration the reboiler bottom stream comprises ethane in an amount of less than 5% by volume, and when the NGL system is in the ethane recovery configuration introducing the first portion bottom stream into the second portion of the separation vessel, cooling the first portion overhead stream in the heat exchanger to yield a chilled first portion overhead stream, introducing the chilled first portion overhead stream into the third portion of the separation vessel, introducing a third portion bottom stream into the second portion of the separation vessel, heating the third portion overhead stream in the heat exchanger, wherein in the ethane recovery configuration the third portion overhead stream comprises ethane in an amount of less than about 10% by volume, introducing a second portion bottom stream into a reboiler, and collecting a reboiler bottom stream, wherein in the ethane recovery configuration the reboiler bottom stream comprises ethane in an amount of at least about 30% by volume.

Also disclosed herein is a natural gas processing (NGL) system, the NGL system being selectively configured in either an ethane rejection configuration or an ethane recovery configuration, the NGL system comprising a heat exchanger, a single column for separation having a first separator portion, a second stripper portion, and a third absorber portion, and a reboiler, wherein the NGL system is configured to cool a feed stream comprising methane, ethane, and propane in the heat exchanger to yield a chilled feed stream, introduce the chilled feed stream into the first portion of the separation vessel, and when the NGL system is in the ethane rejection configuration, the NGL system is further configured to heat a first portion bottom stream in the heat exchanger to yield a heated first portion bottom stream, introduce the heated first portion bottom stream into the second portion of the separation vessel, introduce a first portion overhead stream into the third portion of the separation vessel, introduce a third portion bottom stream into the second portion of the separation vessel, heat a third portion overhead stream in the heat exchanger, wherein in the ethane rejection configuration the third portion overhead stream comprises ethane in an amount of at least 5% by volume, introduce a second portion bottom stream into the reboiler, and collect a reboiler bottom stream, wherein in the ethane rejection configuration the reboiler bottom stream comprises ethane in an amount of less than 5% by volume, and when the NGL system is in the ethane recovery configuration, the NGL system is further configured to introduce the first portion bottom stream into the second portion of the separation vessel, cool the first portion overhead stream in the heat exchanger to yield a chilled first portion overhead stream, introduce the chilled first portion overhead stream into the third portion of the separation vessel, introduce a third portion bottom stream into the second portion, heat the third portion overhead stream in the heat exchanger, wherein in the ethane recovery configuration the third portion overhead stream comprises ethane in an amount of less than 10% by volume, introduce a second portion bottom stream into a reboiler, and collect a reboiler bottom stream, wherein in the ethane recovery configuration the reboiler bottom stream comprises ethane in an amount of at least 30% by volume.

Further disclosed herein is a method for processing gas, comprising feeding a feed gas stream comprising methane, ethane, and C3+ compounds to an integrated separation column, wherein the integrated separation column is selectably configurable between an ethane rejection configuration and an ethane recovery configuration, operating the integrated column in the ethane rejection configuration, wherein the feed gas stream is cooled and subsequently flashed in a bottom isolated portion of the integrated column to form a flash vapor, wherein the flash vapor is reduced in pressure and subsequently fed as a vapor to an upper isolated portion of the integrated column; wherein an overhead stream from an intermediate isolated portion of the integrated column is cooled and fed as a liquid to the upper isolated portion of the integrated column, recovering an overhead residual gas stream comprising methane and ethane from the integrated separation column, wherein the residual gas stream comprises equal to or greater than 40 volume percent of the ethane in the feed gas stream, and recovering a bottom natural gas liquid (NGL) product stream comprising ethane and C3+ compounds from the integrated column.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Disclosed herein are embodiments of systems and methods for processing natural gas. More particularly, disclosed herein are embodiments of systems and methods for selectively recovering or rejecting ethane during the natural gas processing and can recover over 95% to 99% propane during ethane rejection and 50 to 70% ethane during ethane recovery while maintaining high propane recovery.

Figure 1:
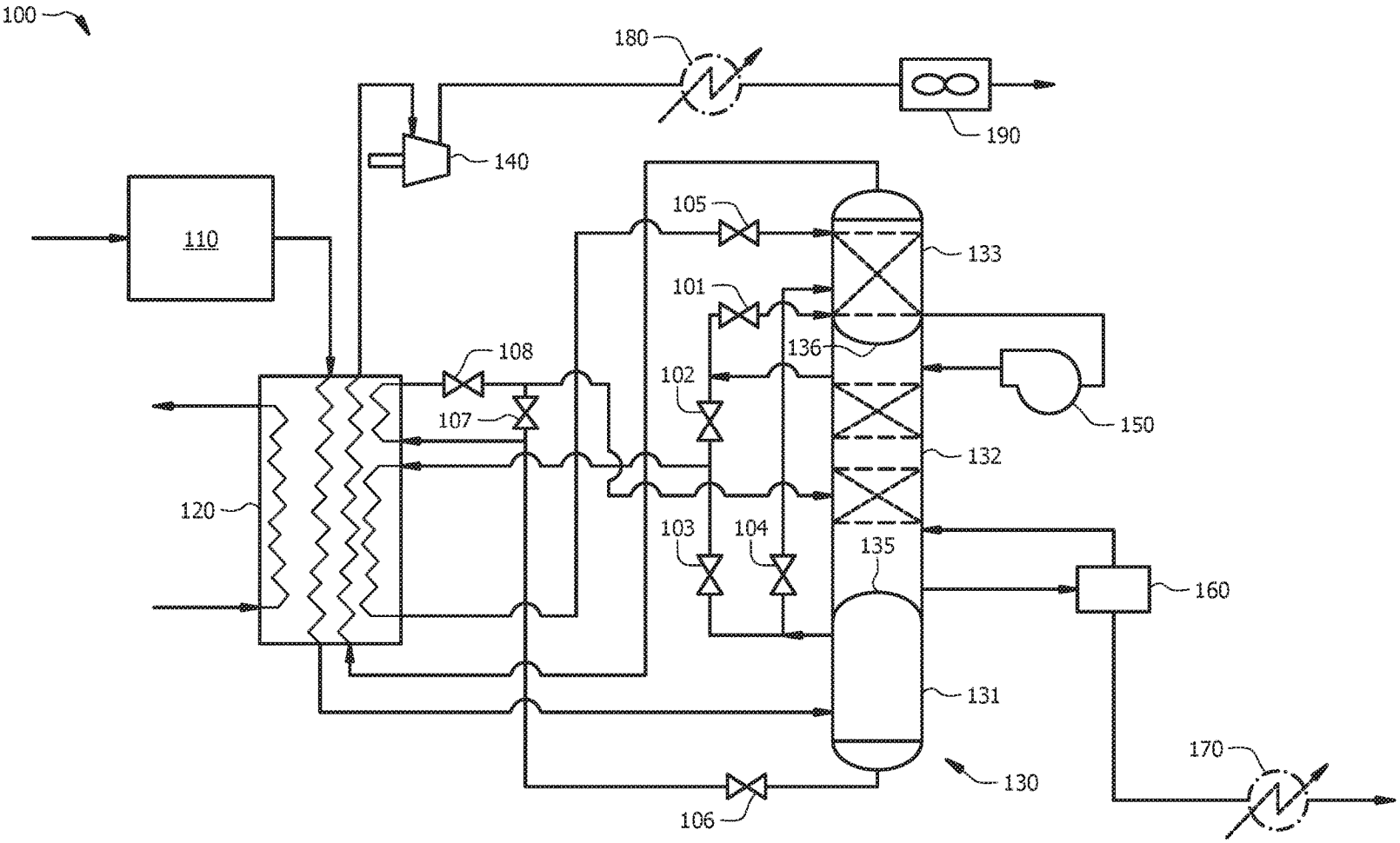
FIG. 1 illustrates a natural gas processing system according to an embodiment disclosed herein.

Referring to FIG. 1, an embodiment of a natural gas liquids processing (NGL) system 100 is illustrated. In an embodiment, the NGL system 100 is selectively configurable for either recovering ethane (e.g., such that ethane is present as a component of a resulting NGL stream) or rejecting ethane (e.g., such that ethane is present as a component of a resulting residue stream) during the natural gas processing.

In the embodiment of FIG. 1, the NGL system 100 comprises a pretreatment unit 110, a plate and frame heat exchanger 120, an integrated separation column 130 having a first (e.g., lower or bottom) portion 131, a second (e.g., intermediate or middle) portion 132, and a third (e.g., upper or top) portion 133. The first portion 131, the second portion 132, and the third portion 133 are disposed within a common vessel or tower, wherein the first portion 131 is structurally isolated from the second portion 132 via isolation barrier 135 (e.g., a bulkhead, plate, concave wall member, etc.) such that fluid flow does not occur internal to the common vessel or tower between the first portion 131 and the second portion 132, and the second portion 132 is structurally isolated from the third portion 133 via isolation barrier 136 (e.g., a bulkhead, plate, concave wall member, etc.) such that fluid flow does not occur internal to the common vessel or tower between the second portion 132 and the third portion 133. Accordingly, in an embodiment, the first portion 131, the second portion 132, and the third portion 133 may function as independent pressure compartments or vessels disposed within a larger, common vessel or vertical tower configuration such that there is no fluid flow or fluid communication internal to the larger, common vessel or vertical tower between the isolated sections. For example, fluid that enters the top of the common vessel or vertical tower is prevented from flowing downward (e.g., by gravity) through the common vessel or vertical tower and exiting the bottom of common vessel or vertical tower, as is otherwise commonplace in a typical distillation column that does not have fluidic and/or pressure isolation portions. Alternatively, the location and placement of these portions can be modified as needed, for example, to meet the mechanical and fabrication requirements. In an embodiment, the integrated separation column 130 and heads can be insulated internally.

The NGL system 100 further comprises a compressor 140, a pressurizing pump 150, a reboiler 160, a first line heat exchanger 170, a second line heat exchanger 180, and an air cooler 190. As shown in FIG. 1, these components are operatively coupled (e.g., in fluid communication as shown in the figures), for example, so as to provide a route of fluid communication between any two or more respective components for the fluid streams as will be disclosed herein in more detail. In various embodiments, the various routes of fluid communication may be provided via a suitable fluid conduit. The various fluid conduits may include, but are not limited to, various classes, configurations, and/or sizes of pipe or tubing which may or may not be jacketed or insulated; bypass lines; isolation and/or shutoff valves; relief and/or safety valves; process control components and instrumentation including sensors; and flanges or other suitable connections between two or more components. Additionally, in the embodiment of FIG. 1, the NGL system 100 comprises a first valve 101, a second valve 102, a third valve 103, a fourth valve 104, a fifth valve 105, a sixth valve 106, a seventh valve 107, and an eighth valve 108. As will be disclosed herein, the various valves (e.g., the first, second, third, fourth, fifth, sixth, seventh, and eighth valves 101, 102, 103, 104, 105, 106, 107, and 108, respectively) may be used to selectively configure the NGL system 100 for either recovering ethane (e.g., such that ethane is present as a component of a resulting NGL stream) or rejecting ethane (e.g., such that ethane is present as a component of a resulting residue stream) during the natural gas processing. More particularly, the first, second, third, fourth, fifth, sixth, seventh, and eighth valves 101, 102, 103, 104, 105, 106, 107, and 108, respectively, may be used to selectively configure the NGL system 100 to selectively allow or disallow a given route of fluid communication, for example, according to at least one of the configurations disclosed herein.

Figure 2:
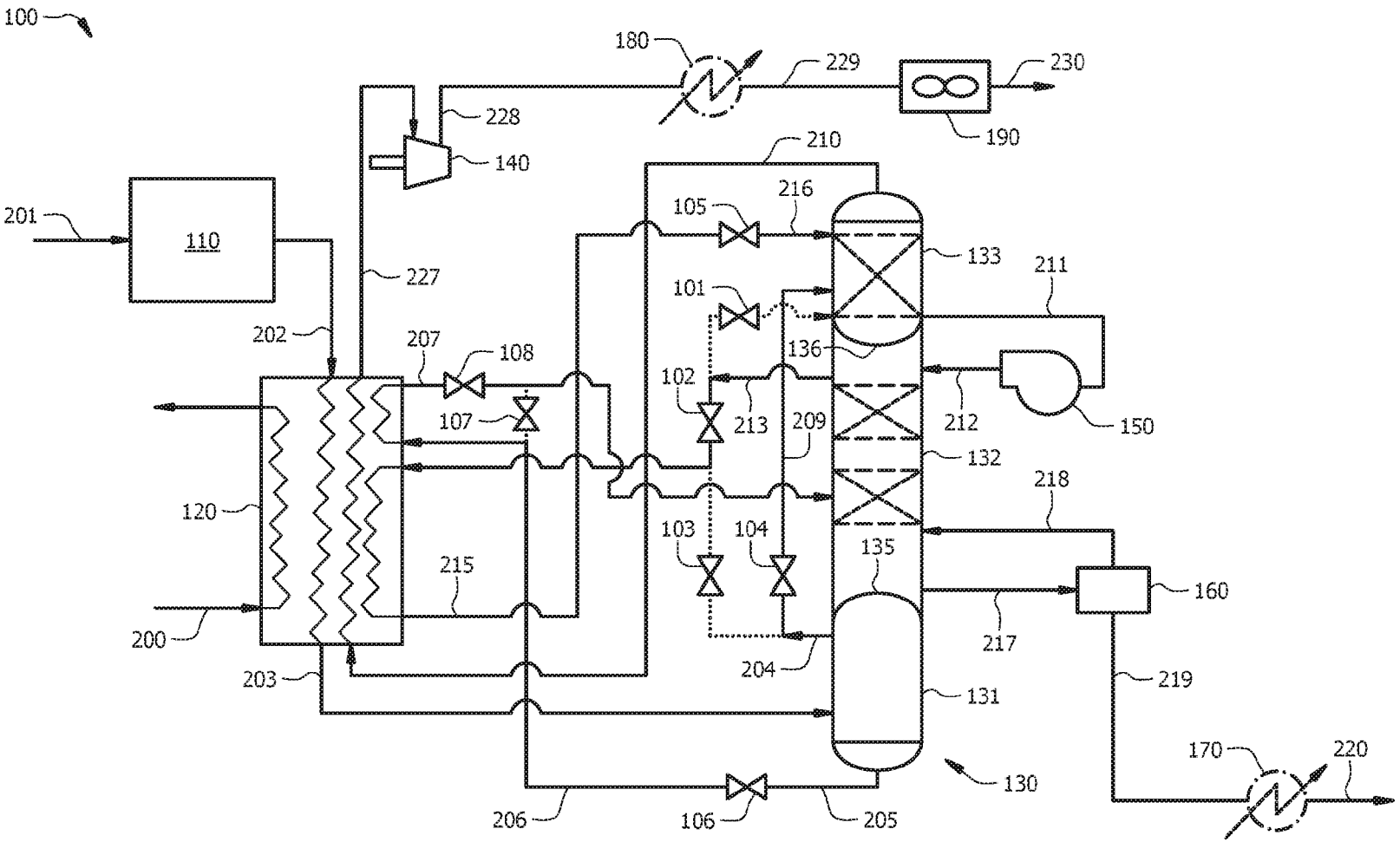
FIG. 2 illustrates the natural gas processing system of FIG. 1 in an ethane rejection configuration.

Referring to FIG. 2, the NGL system 100 of FIG. 1 is illustrated in an "ethane rejection" configuration, for example, such that ethane is produced as a component of the residue stream 230 that results from operation of the NGL system 100 in the configuration of FIG. 2. In the embodiment of FIG. 2, the first, second, third, fourth, fifth, sixth, seventh, and eighth valves 101, 102, 103, 104, 105, 106, 107, and 108, respectively, have been selectively configured so as to allow particular routes of fluid communication and to disallow particular routes of fluid communication. For purposes of illustration, those routes of fluid communication that are allowed are illustrated as solid lines while those routes of fluid communication that are disallowed are illustrated as broken or dotted lines, as will be explained herein.

In the ethane rejection configuration of FIG. 2, the process begins with a feed gas stream 201. The feed gas stream 201 generally comprises the produced (e.g., "raw") gas to be processed; for example, the feed gas stream 201 may comprise methane, ethane, propane, heavier hydrocarbons (e.g., C4, C5, C6, etc. hydrocarbons), nitrogen, carbon dioxide, and hydrogen sulfide and water. In an embodiment, the feed gas stream 201 comprises a "rich" feed gas, for example, produced from an unconventional geological formation, and comprising about 50-80% methane and about 10-30% ethane, with the remainder of the feed gas stream 201 being propane, heavier hydrocarbons (e.g., butane, isobutane, pentane, isopentane, hexane, etc.) and/or trace amounts of various other fluids (nitrogen, carbon dioxide, and hydrogen sulfide).

The feed gas stream 201 is fed into the pretreatment unit 110 which is generally configured for the removal of one or more undesirable components that may be present in the feed gas stream 201. While the embodiment of FIG. 2 illustrates a single pretreatment unit, any pretreatment steps may be carried out in two or more distinct units and/or steps. In an embodiment, pretreatment of the feed gas stream 201 includes an acid gas removal unit to remove one or more acid gases such as hydrogen sulfide, carbon dioxide, and other sulfur contaminants such as mercaptans. For example, an acid gas removal unit may include an amine unit that employs a suitable alkylamine (e.g., diethanolamine, monoethanolamine, methyldiethanolamine, diisopropanolamine, or aminoethoxyethanol (diglycolaminc)) to absorb any acid gases (e.g., hydrogen sulfide or carbon dioxide). In an embodiment, pretreatment of the feed gas stream 201 also includes removal of water in a dehydration unit, an example of which is a molecular sieve, for example, that is generally configured to contact a fluid with one or more desiccants (e.g., molecular sieves, activated carbon materials or silica gel). Another example of a dehydration unit is a glycol dehydration unit, which is generally configured to physically absorb water from the feed gas stream 201 using, for example, triethylene glycol, diethylene glycol, ethylene glycol, or tetraethylene glycol. In addition, the mercury contents in the feed gas must be removed to a very low level to avoid mercury corrosion in the plate and frame heat exchanger 120. The pretreatment unit 110 yields a treated (e.g., sweetened and dehydrated) feed stream 202.

Referring again to FIG. 2, the treated feed stream 202, supplied at pressure typically at about 450 psig to 900 psig, is fed into a heat exchanger, for example fed into the plate and frame heat exchanger 120. An example of such a suitable type and/or configuration of the plate and frame heat exchanger 120 is a brazed aluminum heat exchanger. The plate and frame heat exchanger 120 is generally configured to transfer heat between two or more fluid streams. In the embodiment of FIG. 2, the plate and frame heat exchanger 120 transfers heat between a refrigerant fluid stream 200, the treated feed stream 202, an absorber overhead stream 210, a let-down separator bottoms stream 206, and a stripper overhead stream 213. In an embodiment, for example, when the feed gas stream 201 is supplied at high pressure, second valve 102 functions as a JT valve, thereby chilling the feed gas stream 201. In various embodiments, the refrigerant stream 200 comprises propane refrigerant that may also comprise about 1 volume % ethane and about 1 volume % butane hydrocarbons. Particularly, in the embodiment of FIG. 2, the treated feed stream 202 is cooled by the refrigerant stream 200, the absorber overhead stream 210, and the let-down separator bottoms stream 206 to yield a chilled feed stream 203. The chilled feed stream 203 may have a temperature of from about −15° F. to about −45° F., alternatively, from about −20° F. to about −40° F., alternatively, from about −25° F. to about −36° F.

In the embodiment of FIG. 2, the chilled feed stream 203 is fed as a two phase stream into the integrated separator column 130, particularly, into the first (lower or bottom) portion 131 of the integrated column 130. The first (lower) portion 131 may be configured as a vapor-liquid separator (e.g., a "flash" separator). In such an embodiment, the vapor-liquid separator may be operated at a temperature and/or pressure such that the chilled feed stream 203 undergoes a reduction in pressure upon being introduced therein, for example, so as to cause at least a portion of the chilled feed stream 203 to be "flash" evaporated, for example, thereby forming a "flash vapor" and a "flash liquid." The first (lower) portion 131 of the integrated column (e.g., the vapor-liquid separator) may be operated at a temperature of from about −10° F. to −45° F. and pressure at about 10 to 20 psi higher than the feed supply pressure. Separation in the first (lower) portion 131 yields a separator overhead stream 204 (e.g., the "flash vapor") and a separator bottom stream 205 (e.g., the "flash liquid"). The flash vapor portion comprises, alternatively, consists of, mostly the lighter components, especially methane and ethane components and the flash liquid portion comprises, alternatively, consists of, mostly the heavier components especially propane and butane and heavier components, and as such, the actual compositions also vary with the feed gas composition, and operating pressure and temperature.

In the embodiment of FIG. 2, the separator bottom stream 205 is passed through the sixth valve 106. The sixth valve 106 is configured as a modulating valve which controls the liquid level in first portion 131 (e.g., the vapor-liquid separator), for example, providing sufficient resident time within the vapor-liquid separator, and avoiding vapor breakthrough from the separator. The separator bottom stream 205 (e.g., the "flash liquid") may comprise a saturated liquid which, being an incompressible fluid, does not result in any significant cooling from the pressure drop. The let-down separator bottoms stream 206 resulting from the separator bottom stream 205 being passed through the sixth valve 106 may have a pressure that is about 10 to 20 psi higher than the absorber pressure.

In the embodiment of FIG. 2, the seventh valve 107 is closed and the eighth valve 108 is open. As such, the let-down separator bottoms stream 206 is passed through the plate and frame heat exchanger 120 and is heated, for example, gaining heat from the treated feed stream 202, to yield a heated separator bottoms stream 207. The heated separator bottoms stream 207 may have a temperature of from about 45° F. to about 65° F., alternatively, from about 50° F. to about 65° F., alternatively, from about 52° F. to about 60° F.

In the embodiment of FIG. 2, the heated separator bottoms stream 207 is introduced as a two phase stream into the integrated separator column 130, particularly, into the second (intermediate or middle) portion 132 of the integrated column 130, for example, into a mid-section of the second (intermediate) portion 132. The second (intermediate) portion 132 may be configured as a stripper column. For example, the stripper column may be generally configured to allow one or more components present within a liquid stream to be removed by a vapor stream, for example, by causing the component present within the liquid stream to be preferentially transferred to the vapor stream because of their different volatilities. In such an embodiment, the stripper column may be configured as a tower (e.g., a plate or tray column), a packed column, a spray tower, a bubble column, or combinations thereof. The second (intermediate) portion 132 of the integrated column (e.g., the stripper column) may be operated at an overhead temperature from about 10° F. to −20° F. and at a pressure of about 300 psig to 400 psig.

In the embodiment of FIG. 2, the third valve 103 is closed and the fourth valve 104 is open. As such, the separator overhead stream 204 (i.e., a vapor stream) is passed through the fourth valve 104. The fourth valve 104 is configured as a JT valve or throttling valve. Passing the separator overhead stream 204 through the fourth valve 104 causes a reduction (e.g., a "let-down") in pressure of the separator overhead stream 204, yielding the let-down separator overhead stream 209. The let-down separator overhead stream 209 may have a pressure that is about 5 to 10 psi higher than the operating pressure of the third portion 133 of the integrated column 130 (e.g., the absorber column).

In the embodiment of FIG. 2, the let-down separator overhead stream 209 is introduced into the third (e.g., upper or top) portion 133 of the integrated column, for example, into a lower (e.g., bottom) section of the third (upper) portion 133. The third (upper) portion 133 may be configured as an absorber column (e.g., an absorber or scrubber). For example, the absorber column may be generally configured to allow one or more components present within the ascending vapor stream to be absorbed within a liquid stream. In such an embodiment, the absorber column may be configured as a packed column or another suitable configuration. The third (upper) portion 133 of the integrated column 130 (e.g., the absorber column) may be operated such that an overhead temperature is from about −75° F. to about −45° F., alternatively, from about −70° F. to about −50° F., alternatively, from about −65° F. to about −55° F., a bottom temperature is from about −60° F. to about −10° F., alternatively, from about −65° F. to about −15° F., alternatively, from about −60° F. to about −20° F., and a pressure of from about 300 psig to about 600 psig, alternatively, from about 350 psig to about 500 psig, alternatively, from about 450 psig to about 550 psig. In the embodiment of FIG. 2, operation of the third (upper) portion 133 of the integrated column 130 (e.g., the absorber column) yields the absorber overhead stream 210 and an absorber bottom stream 211.

In the embodiment of FIG. 2, the absorber overhead stream 210 is a vapor comprising methane in an amount of at least 75% by volume, alternatively, from about 80% to about 95%, alternatively, from about 85% to about 90%; ethane in an amount of at least 4% by volume alternatively, from about 10% to about 40%; propane in an amount of less than 5.0% by volume, alternatively, less than 1.0%, alternatively, less than 0.5%; and C4 and heavier hydrocarbons in an amount of less than 0.1% by volume, alternatively, less than 0.05%, alternatively, less than 0.01%.

In the embodiment of FIG. 2, the absorber overhead stream 210 is passed through the plate and frame heat exchanger 120 and is heated, for example, gaining heat from the treated feed stream 202 and the stripper overhead stream 213, to yield a heated residue gas stream 227. The heated residue gas stream 227 may have a temperature of from about 60° F. to about 80° F., alternatively, from about 65° F. to about 75° F., alternatively, about 70° F.

In the embodiment of FIG. 2, the heated residue gas stream 227 is directed to the compressor 140, forming a compressed residue gas stream 228, which is directed to the second line heat exchanger 180. The compressed residue gas stream 228 may be cooled in the second line heat exchanger 180, forming a cooled, compressed residue gas stream 229. The cooled, compressed residue gas stream 229 may be directed to the air cooler (e.g., a trim cooler or finishing cooler), for example, for ensuring that the cooled compressed residue gas stream 229 is of a desired temperature, thereby forming the sales gas stream 230.

In the embodiment of FIG. 2, the absorber bottom stream 211 may be characterized as "ethane-rich," for example, comprising ethane and heavier hydrocarbons in an amount of from about 40% to 70% by volume %, with the balance in methane.

The absorber bottom stream 211 is directed to pressurizing pump 150 to yield a compressed absorber bottom stream 212. The compressed absorber bottom stream 212 may have a pressure at about 10 to 50 psi higher pressure than the second (intermediate) portion 132 of the integrated column 130.

In the embodiment of FIG. 2, the compressed absorber bottom stream 212 is fed as a liquid into the second (intermediate) portion 132 (e.g., the stripper column), for example, into an upper section of the second (intermediate) portion 132. The second portion 132 of the integrated column 130 (e.g., the stripper column) may be operated such that an overhead temperature is from about −30° F. to about 30° F., alternatively, from about −25° F. to about 25° F., alternatively, from about −20° F. to about 20° F., a bottom temperature is from about 100° F. to about 400° F., alternatively, from about 125° F. to about 350° F., alternatively, from about 150° F. to about 300° F. and a pressure of from about 300 psig to about 600 psig, alternatively, from about 350 psig to about 500 psig, alternatively, from about 320 psig to about 400 psig. In the embodiment of FIG. 2, fractionation of the compressed absorber bottom stream 212 and the heated separator bottoms stream 207 in the second portion 132 (e.g., in the stripper column) yields a stripper overhead stream 213 and a stripper bottom stream 217.

The stripper overhead stream 213 may be characterized as methane and ethane (e.g., C2 and lighter hydrocarbons) rich, comprising methane in an amount of at least about 50% by volume, alternatively, at least about 55%, alternatively, at least about 60%, alternatively, at least about 65%; ethane in an amount of at least about 25% by volume, alternatively, at least about 40%, alternatively, at least about 65%; and less than about 20% by volume propane and heavier hydrocarbons, alternatively, less than about 10%, alternatively, less than about 5.0%.

In the embodiment of FIG. 2, the first valve 101 is closed and the second valve 102 is open. As such, the stripper overhead stream 213 exits as a vapor and is directed through the second valve 102 and passed through the plate and frame heat exchanger 120 where the stripper overhead stream 213 is cooled, for example, by the refrigerant stream 200, and the absorber overhead stream 210 to yield a chilled stripper overhead two phase stream 215. The chilled stripper overhead stream 215 may have a temperature of from about −30° F. to about −65° F., alternatively, from about −35° F. to about −60° F., alternatively, from about −40° F. to about −55° F.

In the embodiment of FIG. 2, the chilled stripper overhead stream 215 is passed through the fifth valve 105. The fifth valve 105 is configured as a JT valve or throttling valve. Passing the chilled stripper overhead stream 215 through the fifth valve 105 causes a reduction (e.g., a "let-down") in pressure of the chilled stripper overhead stream 215, yielding the let-down stripper overhead stream 216. The let-down stripper overhead stream 216 may have a pressure that is 5 to 10 psi higher than the third (upper) portion 133 (e.g., the absorber column).

In the embodiment of FIG. 2, the let-down stripper overhead stream 216 is fed as a two phase stream (vapor and liquid) into the third (upper) portion 133 of the integrated column 130 (e.g., the absorber column), for example, into the top tray in the upper section of the third (upper) portion 133. The let-down stripper overhead stream 216 may function as a reflux stream (e.g., a vapor liquid stream), for example, a lean ethane enriched lean reflux stream.

In the embodiment of FIG. 2, the stripper bottom stream 217 is removed as a liquid and directed to the reboiler 160. The reboiler 160 may be operated at a temperature of from about 200 to 300° F. at a pressure that is 10 psi to 100 psi higher than the third (upper) portion 133 of the integrated column 130 (e.g., the absorber column). In an embodiment, the reboiler 160 may be heated via waste heat from the process (e.g., heat from the compressed residue gas stream 228) or, alternatively, via heat from a suitable external source such as hot oil or steam. A reboiler overhead stream 218 (e.g., a vapor stream) is returned to the bottom tray of the second portion 132 of the integrated column 130 (e.g., the stripper column). The reboiler, which may be a kettle-type exchanger, yields a liquid stream 219 at about 5° F. to 10° F. higher than stream 217. The liquid stream 219 is directed to the first line heat exchanger 170. The liquid stream 219 may be cooled in the first line heat exchanger 170, forming a NGL product stream 220.

The NGL product stream 220 may be characterized as comprising propane and heavier hydrocarbons. For example, the NGL product stream 220 comprises methane in an amount of less than about 0.1% by volume, alternatively, less than about 0.01%, alternatively, less than about 0.001%; ethane in an amount of from about 1% to about 5% by volume alternatively, from about 2% to about 4%; propane and heavier hydrocarbons in amount of at least 80% by volume, alternatively, at least about 90%, alternatively, at least about 95%, alternatively, at least about 96%, alternatively, at least about 97%. In an embodiment, the NGL product stream 220 may be characterized as Y-grade NGL, for example, having a methane content not exceeding 1.5 volume % of the ethane content and having a $CO_2$ content not exceeding 0.35 volume % of the ethane content.

In the ethane rejection configuration of FIG. 2, 90 to 99% of the propane plus present in feed gas stream 201 is recovered in the NGL product stream 220, and 90 to 99% of the ethane present in feed gas stream 201 is rejected to stream 230.

Figure 3:
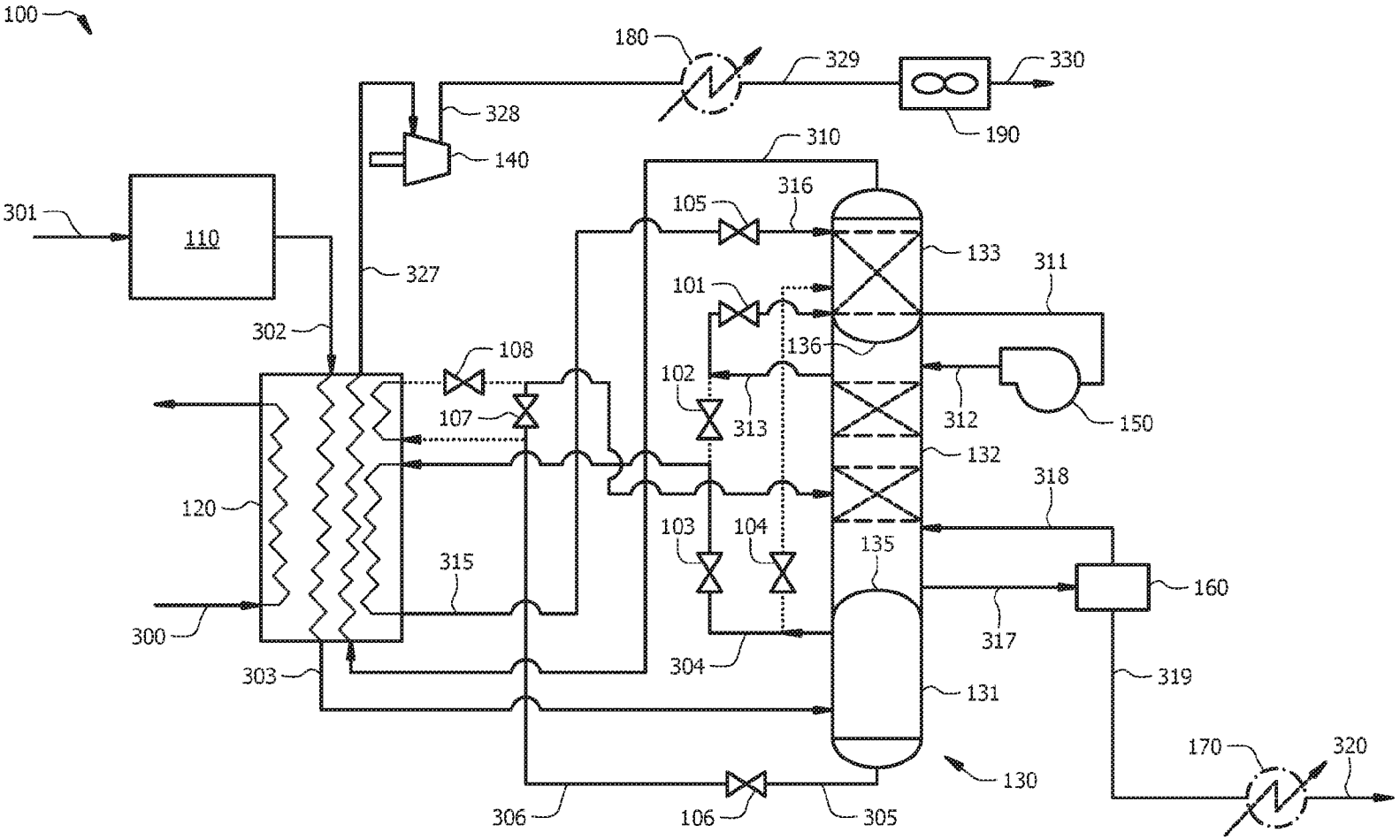
FIG. 3 illustrates the natural gas processing system of FIG. 1 in an ethane recovery configuration.

Referring to FIG. 3, the NGL system 100 of FIG. 1 is illustrated in an "ethane recovery" configuration, for example, such that ethane is produced as a component of the NGL product stream 320 that results from operation of the NGL system 100 in the configuration of FIG. 3. In the embodiment of FIG. 3, the first, second, third, fourth, fifth, sixth, seventh, and eighth valves 101, 102, 103, 104, 105, 106, 107, and 108, respectively, have been selectively configured so as to allow particular routes of fluid communication and to disallow particular routes of fluid communication. For purposes of illustration, those routes of fluid communication that are allowed are illustrated as solid lines while those routes of fluid communication that are disallowed are illustrated as broken or dotted lines, as will be explained herein.

In the ethane recovery configuration of FIG. 3, the process begins with a feed gas stream 301. As similarly disclosed with respect to FIG. 2, the feed gas stream 301 generally comprises the produced (e.g., "raw") gas to be processed; for example, the feed gas stream 301 may comprise methane, ethane, propane, heavier hydrocarbons (e.g., C4, C5, C6, etc. hydrocarbons), nitrogen, carbon dioxide, and hydrogen sulfide and water. In an embodiment, the feed gas stream 301 comprises a "rich" feed gas, for example, produced from a non-conventional geological formation, and comprising about 50-80% methane and about 10-30% ethane, with the remainder of the feed gas stream 301 being propane, heavier hydrocarbons (e.g., butane, isobutane, pentane, isopentane, hexane, etc.) and/or trace amounts of various other fluids (nitrogen, carbon dioxide, and hydrogen sulfide and mercaptans).

The feed gas stream 301 is fed into the pretreatment unit 110 which, as previously disclosed with respect to FIG. 2, is generally configured for the removal of one or more undesirable components that may be present in the feed gas stream 301. As similarly disclosed with respect to FIG. 2, in an embodiment, pretreatment of the feed gas stream 301 includes removal of hydrogen sulfide and carbon dioxide and removal of water and mercury. The pretreatment unit 110 yields a treated (e.g., sweetened and dehydrated) feed stream 302.

Referring again to FIG. 3, the treated feed stream 302 is fed into the plate and frame heat exchanger 120. In the embodiment of FIG. 3, the plate and frame heat exchanger 120 transfers heat between a refrigerant fluid stream 300, the treated feed stream 302, and an absorber overhead stream 310. Particularly, in the embodiment of FIG. 3, the treated feed stream 302 is cooled by the refrigerant stream 300 and the absorber overhead stream 310 to yield a chilled feed stream 303. The chilled feed stream 303 may have a temperature of from about −15° F. to about −45° F., alternatively, from about −20° F. to about −40° F., alternatively, from about −25° F. to about −36° F.

In the embodiment of FIG. 3, the chilled feed stream 303 is fed into the integrated separator column 130, particularly, into the first (lower) portion 131 of the integrated column 130, (e.g., the vapor-liquid separator or "flash" separator). In the ethane recovery configuration of FIG. 3, the first (lower) portion 131 of the integrated column 130 (e.g., the vapor-liquid separator) may be operated at a temperature and pressure equal to that of the chilled feed stream 303. Separation in the first (lower) portion 131 yields a separator overhead stream 304 (e.g., the "flash vapor") and a separator bottom stream 305 (e.g., the "flash liquid").

In the embodiment of FIG. 3, the separator bottom stream 305 is passed through the sixth valve 106. The sixth valve 106 is configured as a modulating valve which controls the liquid level in first portion 131 (e.g., the vapor-liquid separator), for example, providing sufficient resident time within the vapor-liquid separator, and avoiding vapor breakthrough from the separator. The separator bottom stream 305 (e.g., the "flash liquid") may comprise a saturated liquid which, being an incompressible fluid, does not result in any significant cooling from the pressure drop. The let-down separator bottoms stream 306 resulting from the separator bottom stream 305 being passed through the sixth valve 106 may have a pressure of 10 to 20 psi higher than that of second (intermediate) portion 132 of the integrated column 130 (e.g., the stripper column).

In the embodiment of FIG. 3, the seventh valve 107 is open and the eighth valve 108 is closed. As such, the let-down separator bottoms stream 306 bypasses the plate and frame heat exchanger 120 and is introduced into the second (intermediate) portion 132 of the integrated column 130, for example, into a mid-section of the second (intermediate) portion 132 (e.g., the stripper column).

In the embodiment of FIG. 3, the third valve 103 is open and the fourth valve 104 is closed. As such, the separator overhead stream 304 is passed through the third valve 103 and passed through the plate and frame heat exchanger 120 where the separator overhead stream 304 is cooled, for example, by the refrigerant stream 300 and the absorber overhead stream 310 to yield a chilled separator overhead stream 315. The chilled separator overhead stream 315 may have a temperature of from about −60° F. to about −135° F., alternatively, from about −70° F. to about −110° F., alternatively, from about −50° F. to about −80° F.

In the embodiment of FIG. 3, the chilled separator overhead stream 315 is passed through the fifth valve 105. The fifth valve 105 is configured as a IT valve or throttling valve. Passing the chilled separator overhead stream 315 through the fifth valve 105 causes a reduction (e.g., a "let-down") in pressure of the chilled separator overhead stream 315, yielding the let-down separator overhead stream 316. The let-down separator overhead stream 316 may have a pressure that is 5 to 10 psi higher than third (upper) portion 133 of the integrated column 130 (e.g., the absorber column).

In the embodiment of FIG. 3, the let-down separator overhead stream 316 is fed as a liquid into the third (upper) portion 133 of the integrated column 130 (e.g., the absorber column), for example, into the top tray of the third (upper) portion 133 (e.g., the absorber column or "scrubber"). In the ethane recovery configuration of FIG. 3, the third (upper) portion 133 of the integrated column 130 (e.g., the absorber column) may be operated at a temperature of from about −130° F. to about −70° F., alternatively, from about −125° F. to about −75° F., alternatively, from about −120° F. to about −80° F., and a pressure of from about 350 psig to about 650 psig, alternatively, from about 400 psig to about 500 psig, alternatively, from about 450 psig to about 550 psig. In the embodiment of FIG. 3, operation of the third (upper) portion 133 of the integrated column 130 (e.g., the absorber column) yields the absorber overhead stream 310 and an absorber bottom stream 311.

In the embodiment of FIG. 3, the absorber overhead stream 310 comprises methane in an amount of at least 75% by volume, alternatively, from about 80% to about 98%, alternatively, from about 85% to about 95%; ethane in an amount of less than 10% by volume, alternatively, less than about 5%; propane and heavier hydrocarbons in an amount of less than 2.0% by volume, alternatively, less than 1.0%, alternatively, less than 0.5%, alternatively, less than 0.1% by volume.

In the embodiment of FIG. 3, the absorber overhead stream 310 is passed through the plate and frame heat exchanger 120 and is heated, for example, gaining heat from the treated feed stream 302 and the separator overhead stream 304, to yield a heated residue gas stream 327. The heated residue gas stream 327 may have a temperature of from about 60° F. to about 80° F., alternatively, from about 65° F. to about 75° F., alternatively, about 70° F.

In the embodiment of FIG. 3, the heated residue gas stream 327 is directed to the compressor 140, forming a compressed residue gas stream 328, which is directed to the second line heat exchanger 180. The compressed residue gas stream 328 may be cooled in the second line heat exchanger 180, forming a cooled, compressed residue gas stream 329. The cooled, compressed residue gas stream 329 may be directed to the air cooler (e.g., a trim cooler or finishing cooler), for example, for ensuring that the cooled, compressed residue gas stream 329 is of a desired temperature, thereby forming the sales gas stream 330.

In the embodiment of FIG. 3, the absorber bottom stream 311 may comprise methane in an amount of from about 40% to about 90% by volume, alternatively, from about 50% to about 80% by volume, alternatively, from about 60% to about 70% by volume; ethane in an amount of at least 50% by volume alternatively, from about 60% to about 75% by volume; propane and C4 and heavier hydrocarbons in amount of 10% by volume, alternatively, 5% by volume, alternatively, 1% by volume.

The absorber bottom stream 311 is directed to pressurizing pump 150 to yield a compressed absorber bottom stream 312. The compressed absorber bottom stream 312 may have a pressure of from about 10 to 40 psi higher than the second (intermediate) portion 132 (e.g., the stripper column).

In the embodiment of FIG. 3, the compressed absorber bottom stream 312 is fed as a liquid into the second (intermediate) portion 132 (e.g., the stripper column), for example, into a top tray in the upper section of the second (intermediate) portion 132. In the ethane recovery configuration of FIG. 3, the second portion 132 of the integrated column 130 (e.g., the stripper column) may be operated such that an overhead temperature is from about −90° F. to about −50° F., alternatively, from about −85° F. to about −55° F., alternatively, from about −80° F. to about −60° F., a bottom temperature is from about 50° F. to about 150° F., alternatively, from about 75° F. to about 125° F., alternatively, about 100° F., and a pressure of from about 350 psig to about 650 psig, alternatively, from about 400 psig to about 500 psig, alternatively, from about 450 psig to about 550 psig. In the embodiment of FIG. 3, fractionation of the compressed absorber bottom stream 312 and the let-down separator bottoms stream 306 in the second portion 132 (e.g., in the stripper column) yields a stripper overhead stream 313 and a stripper bottom stream 317.

In the embodiment of FIG. 3, the first valve 101 is open and the second valve 102 is closed. As such, the stripper overhead stream 313 is directed through the first valve 101 and is fed as a vapor into the third (upper) portion 133 of the integrated column 130 (e.g., the absorber column), for example, into the bottom tray of the lower section of the third (upper) portion 133. The stripper overhead stream 313 may function as a stripping gas or liquid, for example, a lean stream having a temperature cooler than that of the third portion 133 of the integrated column such that at least a portion of the vapor in the third portion 133 of the column is condensed. The stripper overhead stream 313 may be characterized as methane rich, comprising methane in an amount of at least about 85% by volume, alternatively, at least about 90%, alternatively, at least about 91%, alternatively, at least about 92%, alternatively, at least about 93%, alternatively, at least about 94%, alternatively, at least about 95%; and less than about 40% by volume ethane and heavier hydrocarbons, alternatively, less than about 7.5%, alternatively, less than 5.0%.

In the embodiment of FIG. 3, the stripper bottom stream 317 is directed to the reboiler 160. The reboiler 160 may be operated at a temperature of about 60° F. to 200° F., at a pressure about 5 to 20 psi higher than third portion 133 of the integrated column 130 (e.g., the absorber column). In an embodiment, the reboiler 160 may be heated via waste heat from the process (e.g., heat from the compressed residue gas stream 328) or, alternatively, via heat from a suitable external source, such as hot oil or steam. A reboiler overhead stream 318 (e.g., a vapor stream) is returned to the second portion 132 of the integrated column 130 (e.g., the stripper column). The reboiler 160 also yields a reboiler bottom stream 319. The reboiler bottom stream 319 is directed to the first line heat exchanger 170. The reboiler bottom stream 319 may be cooled in the first line heat exchanger 170, forming a NGL product stream 320.

The NGL product stream 320 may be characterized as comprising ethane and heavier hydrocarbons. For example, the NGL product stream 320 comprises methane in an amount of less than about 2% by volume, alternatively, about 1%; ethane in an amount of from about 30% to about 70% by volume alternatively, from about 40% to about 60%, alternatively, about 50%; propane and heavier hydrocarbons in amount of at least 20% by volume, alternatively, at least about 25%, alternatively, at least about 30%, alternatively, at least about 35%, alternatively, at least about 40%. In an embodiment, the NGL product stream 320 may be characterized as Y-grade NGL, for example, having a methane content not exceeding 1.5 volume % of the methane to ethane ratio in methane content and having a $CO_2$ content not exceeding 0.35 volume % of the $CO_2$ to ethane ratio in $CO_2$ content.

In the ethane recovery configuration of FIG. 3, from equal to or greater than 40 to 70, volume percent of the ethane present in feed gas stream 301 is recovered in the NGL product stream 320, and 95% to 99% of the propane plus content is also recovered in the NGL product stream 320.

An NGL system 100 of the type disclosed herein with respect to FIGS. 1, 2, and 3 may be advantageously employed in natural gas processing. In various embodiments, the NGL system 100 disclosed herein may be configured, selectively, for either "ethane rejection" or "ethane recovery," and is simple, flexible, and low-cost to design and build. The single integrated column design is a cost efficient compact design that has multi-functions, for example, vapor liquid separation, absorption and stripping function.

For example, the disclosed NGL system 100 may be employed in either an "ethane rejection" configuration or an "ethane recovery" configuration, allowing ethane to be selectively output as either a component of a sales gas stream or a component of a NGL stream. For example, in the "ethane rejection" configuration (e.g., FIG. 2), the NGL system 100 allows for about 90-99% of the propane contained within the feed gas stream to be recovered in NGL product stream 220, while in the "ethane recovery" configuration (e.g., FIG. 3), the NGL system 100 allows for about 40-70% of the ethane within the feed gas stream to be recovered in the NGL product stream 320.

Additionally, as is apparent from FIGS. 1, 2, and 3, and the disclosure herein, the NGL system 100 can be transitioned between the "ethane recovery" and "ethane rejection" configurations without the need to add any additional equipment to the system (or vice versa), for example, without the need for a deethanizer. The ability to selectively configure the NGL system 100 between "ethane recovery" and "ethane rejection" allows for financially optimized operation of the NGL system 100 in response to operational considerations (e.g., an operational need for residual gas as a fuel or feed source) and market demands and pricing for residual gas and NGL products.

Also, as is apparent from the embodiment of FIGS. 1, 2, and 3, and the disclosure herein, the NGL system 100 does not require a turbo-expander, whereas conventional natural gas processing facilities often employ one or more turbo-expanders for processing. Moreover, the NGL system 100 disclosed herein is scalable; that is, may be configured to process natural gas at a relatively wide range of throughputs. Not intending to be bound by theory, because turbo-expanders are often limited to very specific throughput ranges, for example, 50% of the design capacity, because of the aerodynamic limitations associated with such rotating equipment, the use of turbo-expanders in conventional natural gas processing facilities may limit the throughput range across which such facilities may be operated without becoming inefficient and/or uneconomical. The NGL system 100 disclosed herein may be employed to process produced gas that is highly variable in composition, for example, both "lean" and "rich" produced gases from conventional or non-conventional geological formations.

EXAMPLES

The following examples illustrate the operation of an NGL system, such as NGL system 100 disclosed previously. Particularly, the following examples illustrate the operation of an NGL system like NGL system 100 in both an "ethane rejection" configuration and an "ethane recovery" configuration. Table 1 illustrates the composition of various streams (in mole percent) and the volumetric flow (in million standard cubic feet of gas per day, MMscfd) corresponding to the stream disclosed with respect to FIG. 2 (i.e., ethane rejection).

TABLE 1

| | 203 | 213 | 220 | 230 |
|---|---|---|---|---|
| $N_2$ | 0.94 | 0.29 | 0.00 | 1.01 |
| $CO_2$ | 0.20 | 0.32 | 0.00 | 0.21 |
| C1 | 80.29 | 61.30 | 0.00 | 86.21 |
| C2 | 11.52 | 33.83 | 3.00 | 12.16 |
| C3 | 4.40 | 3.99 | 58.56 | 0.40 |
| iC4 | 0.67 | 0.13 | 9.72 | 0.00 |
| nC4 | 1.22 | 0.13 | 17.65 | 0.00 |
| iC5 | 0.29 | 0.01 | 4.17 | 0.00 |
| nC5 | 0.34 | 0.01 | 4.89 | 0.00 |
| C6+ | 0.14 | 0.00 | 2.01 | 0.00 |
| MMscfd | 200.0 | 52.6 | 13.8 | 186.3 |
| Phase | Vapor-liquid | vapor | liquid | vapor |

Table 2 illustrates the composition of various streams corresponding to the stream disclosed with respect to FIG. 3 (i.e., ethane recovery).

TABLE 2

| | 303 | 313 | 320 | 330 |
|---|---|---|---|---|
| $N_2$ | 0.94 | 0.32 | 0.00 | 1.10 |
| $CO_2$ | 0.20 | 0.20 | 0.45 | 0.15 |
| C1 | 80.29 | 93.95 | 1.32 | 93.64 |
| C2 | 11.52 | 5.15 | 51.55 | 4.76 |
| C3 | 4.40 | 0.36 | 28.47 | 0.33 |
| iC4 | 0.67 | 0.01 | 4.58 | 0.01 |
| nC4 | 1.22 | 0.01 | 8.35 | 0.01 |
| iC5 | 0.29 | 0.00 | 1.98 | 0.00 |
| nC5 | 0.34 | 0.00 | 2.32 | 0.00 |
| C6+ | 0.14 | 0.00 | 0.96 | 0.00 |
| MMscfd | 200.0 | 39.9 | 28.9 | 171.1 |
| Phase | Vapor-liquid | vapor | liquid | vapor |

Additional Embodiments

A first embodiment, which is a method for operating a natural gas liquids processing (NGL) system, the system being selectively configured in either an ethane rejection configuration or an ethane recovery configuration, the method comprising cooling a feed stream comprising methane, ethane, and propane in a heat exchanger to yield a chilled feed stream; introducing the chilled feed stream into a separation vessel having a first portion, a second portion, and a third portion, wherein the chilled feed stream is introduced into the first portion of the separation vessel; and when the NGL system is in the ethane rejection configuration heating a first portion bottom stream in the heat exchanger to yield a heated first portion bottom stream; introducing the heated first portion bottom stream into the second portion of the separation vessel; introducing a first portion overhead stream into the third portion of the separation vessel; introducing a third portion bottom stream into the second portion; heating a third portion overhead stream in the heat exchanger, wherein in the ethane rejection configuration the third portion overhead stream comprises ethane in an amount of at least about 5% by volume; introducing a second portion bottom stream into a reboiler; and collecting a reboiler bottom stream, wherein in the ethane rejection configuration the reboiler bottom stream comprises ethane in an amount of less than 5% by volume; and when the NGL system is in the ethane recovery configuration introducing the first portion bottom stream into the second portion of the separation vessel; cooling the first portion overhead stream in the heat exchanger to yield a chilled first portion overhead stream; introducing the chilled first portion overhead stream into the third portion of the separation vessel; introducing a third portion bottom stream into the second portion of the separation vessel; heating the third portion overhead stream in the heat exchanger, wherein in the ethane recovery configuration the third portion overhead stream comprises ethane in an amount of less than about 10% by volume; introducing a second portion bottom stream into a reboiler; and collecting a reboiler bottom stream, wherein in the ethane recovery configuration the reboiler bottom stream comprises ethane in an amount of at least about 30% by volume.

A second embodiment, which is the method of the first embodiment, wherein the feed gas stream comprises from about 5 to about 12 gallons of ethane per thousand standard cubic feet of gas.

A third embodiment, which is the method of one of the first through the second embodiments, wherein the chilled feed stream has a temperature of from about −15° F. to about −45° F.

A fourth embodiment, which is the method of one of the first through the third embodiments, wherein the NGL system comprises a first valve, a second valve, a third valve, a fourth valve, a fifth valve, a sixth valve, a seventh valve, and an eighth valve, wherein the first, second, third, fourth, fifth, sixth, seventh, and eighth valves allow particular routes of fluid communication and to disallow particular routes of fluid communication so as to configure the NGL system in either the ethane rejection configuration or the ethane recovery configuration.

A fifth embodiment, which is the method of the fourth embodiment, wherein the first portion bottom stream is directed, in the ethane rejection configuration, to the heat exchanger or, in the ethane recovery configuration, to the second portion of the separation vessel via the sixth valve, wherein directing the first portion bottom stream through the sixth valve causes a reduction in pressure of the first portion bottom stream.

A sixth embodiment, which is the method of one of the fourth through the fifth embodiments, wherein in the ethane rejection configuration, the fourth valve is open, the third valve is closed, and the first portion overhead stream is introduced into the third portion of the separation vessel via the fourth valve, and in the ethane recovery configuration, the third valve is open, the fourth valve is closed, and the first portion overhead stream is introduced into the heat exchanger via the third valve.

A seventh embodiment, which is the method of the sixth embodiment, wherein directing the first portion overhead stream through the fourth valve causes a reduction in pressure of the first portion overhead stream.

An eighth embodiment, which is the method of one of the fourth through the seventh embodiments, wherein in the ethane rejection configuration, the seventh valve is closed and the eighth valve is open, and in the ethane recovery configuration, the seventh valve is open, the eighth valve is closed, and the first portion bottom stream is introduced into the second portion of the separation vessel via the seventh valve.

A ninth embodiment, which is the method of one of the fourth through the eighth embodiments, further comprising when the NGL system is in the ethane rejection configuration cooling a second portion overhead stream in the heat exchanger to yield a chilled second portion overhead stream; and introducing the chilled second portion overhead stream into the third portion of the separation vessel; and when the NGL system is in the ethane recovery configuration introducing the second portion overhead stream into the third portion of the separation vessel.

A tenth embodiment, which is the method of the ninth embodiment, wherein in the ethane rejection configuration, the first valve is closed, the second valve is open, and the second portion overhead stream is introduced into the heat exchanger via the second valve, and in the ethane recovery configuration, the first valve is open, the second valve is closed, and the second portion overhead stream is introduced into the third portion of the separation vessel via the first valve.

An eleventh embodiment, which is the method of one of the ninth through the tenth embodiments, wherein the chilled second portion overhead stream is introduced into the third portion of the separation vessel via the fifth valve, wherein directing the chilled second portion overhead stream through the fifth valve causes a reduction in pressure of the chilled second portion overhead stream.

A twelfth embodiment, which is the method of one of the first through the eleventh embodiments, further comprising, in both the ethane rejection configuration and the ethane recovery configuration, returning a reboiler overhead stream to the second portion of the separation vessel.

A thirteenth embodiment, which is a natural gas processing (NGL) system, the NGL system being selectively configured in either an ethane rejection configuration or an ethane recovery configuration, the NGL system comprising a heat exchanger; a single column for separation having a first separator portion, a second stripper portion, and a third absorber portion; and a reboiler, wherein the NGL system is configured to cool a feed stream comprising methane, ethane, and propane in the heat exchanger to yield a chilled feed stream; introduce the chilled feed stream into the first portion of the separation vessel; and when the NGL system is in the ethane rejection configuration, the NGL system is further configured to heat a first portion bottom stream in the heat exchanger to yield a heated first portion bottom stream; introduce the heated first portion bottom stream into the second portion of the separation vessel; introduce a first portion overhead stream into the third portion of the separation vessel; introduce a third portion bottom stream into the second portion of the separation vessel; heat a third portion overhead stream in the heat exchanger, wherein in the ethane rejection configuration the third portion overhead stream comprises ethane in an amount of at least 5% by volume; introduce a second portion bottom stream into the reboiler; and collect a reboiler bottom stream, wherein in the ethane rejection configuration the reboiler bottom stream comprises ethane in an amount of less than 5% by volume; and when the NGL system is in the ethane recovery configuration, the NGL system is further configured to introduce the first portion bottom stream into the second portion of the separation vessel; cool the first portion overhead stream in the heat exchanger to yield a chilled first portion overhead stream; introduce the chilled first portion overhead stream into the third portion of the separation vessel; introduce a third portion bottom stream into the second portion; heat the third portion overhead stream in the heat exchanger, wherein in the ethane recovery configuration the third portion overhead stream comprises ethane in an amount of less than 10% by volume; introduce a second portion bottom stream into a reboiler; and collect a reboiler bottom stream, wherein in the ethane recovery configuration the reboiler bottom stream comprises ethane in an amount of at least 30% by volume.

A fourteenth embodiment, which is the method of the thirteenth embodiment, wherein the NGL system further comprises a first valve, a second valve, a third valve, a fourth valve, a fifth valve, a sixth valve, a seventh valve, and an eighth valve, wherein the first, second, third, fourth, fifth, sixth, seventh, and eighth valves allow particular routes of fluid communication and to disallow particular routes of fluid communication so as to configure the NGL system in either the ethane rejection configuration or the ethane recovery configuration.

A fifteenth embodiment, which is the method of the fourteenth embodiment, wherein the NGL system is further configured such that the first portion bottom stream is directed, in the ethane rejection configuration, to the heat exchanger or, in the ethane recovery configuration, to the second portion of the separation vessel via the sixth valve, wherein directing the first portion bottom stream through the sixth valve causes a reduction in pressure of the first portion bottom stream.

A sixteenth embodiment, which is the method of one of the fourteenth through the fifteenth embodiments, wherein the NGL system is further configured such that in the ethane rejection configuration, the fourth valve is open, the third valve is closed, and the first portion overhead stream is introduced into the third portion of the separation vessel via the fourth valve, and in the ethane recovery configuration, the third valve is open, the fourth valve is closed, and the first portion overhead stream is introduced into the heat exchanger via the third valve.

A seventeenth embodiment, which is the method of the sixteenth embodiment, wherein the NGL system is further configured such that directing the first portion overhead stream through the fourth valve causes a reduction in pressure of the first portion overhead stream.

An eighteenth embodiment, which is the method of one of the fourteenth through the seventeenth embodiments, wherein the NGL system is further configured such that in the ethane rejection configuration, the seventh valve is closed and the eighth valve is open, and in the ethane recovery configuration, the seventh valve is open, the eighth valve is closed, and the first portion bottom stream is introduced into the second portion of the separation vessel via the seventh valve.

A nineteenth embodiment, which is the method of the fourteenth through the eighteenth embodiments, wherein when the NGL system is in the ethane rejection configuration, the NGL system is further configured to cool a second portion overhead stream in the heat exchanger to yield a chilled second portion overhead stream; and introduce the chilled second portion overhead stream into the third portion of the separation vessel; and when the NGL system is in the ethane recovery configuration, the NGL system is further configured to introduce the second portion overhead stream into the third portion of the separation vessel.

A twentieth embodiment, which is the method of the nineteenth embodiment, wherein the NGL system is further configured such that in the ethane rejection configuration, the first valve is closed, the second valve is open, and the second portion overhead stream is introduced into the heat exchanger via the second valve, and in the ethane recovery configuration, the first valve is open, the second valve is closed, and the second portion overhead stream is introduced into the third portion of the separation vessel via the first valve.

A twenty-first embodiment, which is the method of the nineteenth through the twentieth embodiments, wherein the NGL system is further configured such that the chilled second portion overhead stream is introduced into the third portion of the separation vessel via the fifth valve, wherein directing the chilled second portion overhead stream through the fifth valve causes a reduction in pressure of the chilled second portion overhead stream.

A twenty-second embodiment, which is the method of the thirteenth through the twenty-first embodiments, wherein in both the ethane rejection configuration and the ethane recovery configuration, the NGL system is further configured to return a reboiler overhead stream to the second portion of the separation vessel.

A twenty-third embodiment, which is a method for processing gas, comprising feeding a feed gas stream comprising methane, ethane, and C3+ compounds to an integrated separation column, wherein the integrated separation column is selectably configurable between an ethane rejection configuration and an ethane recovery configuration; operating the integrated column in the ethane rejection configuration, wherein the feed gas stream is cooled and subsequently flashed in a bottom isolated portion of the integrated column to form a flash vapor, wherein the flash vapor is reduced in pressure and subsequently fed as a vapor to an upper isolated portion of the integrated column; wherein an overhead stream from an intermediate isolated portion of the integrated column is cooled and fed as a liquid to the upper isolated portion of the integrated column; recovering an overhead residual gas stream comprising methane and ethane from the integrated separation column, wherein the residual gas stream comprises equal to or greater than 40 volume percent of the ethane in the feed gas stream; and recovering a bottom natural gas liquid (NGL) product stream comprising ethane and C3+ compounds from the integrated column.

A twenty-fourth embodiment, which is the method of the twenty-third embodiment, further comprising discontinuing operation of the integrated separation column in the ethane rejection configuration; reconfiguring the integrated separation column from the ethane rejection configuration to the ethane recovery configuration; operating the integrated column in the ethane rejection configuration, wherein the feed gas stream is cooled and subsequently flashed in a bottom isolated portion of the integrated column to form a flash vapor, wherein the flash vapor is cooled and subsequently fed as a liquid to an upper isolated portion of the integrated column; wherein an overhead stream from an intermediate isolated portion of the integrated column is fed as a vapor to the upper isolated portion of the integrated column; recovering an overhead residual gas stream comprising methane and ethane from the integrated separation column; and recovering a bottom natural gas liquid (NGL) product stream comprising ethane and C3+ compounds from the integrated column, wherein the residual gas stream comprises equal to or greater than 95 volume percent of the ethane in the feed gas stream.

While embodiments of the disclosure have been shown and described, modifications thereof can be made without departing from the spirit and teachings of the invention. The embodiments and examples described herein are exemplary only, and are not intended to be limiting. Many variations and modifications of the invention disclosed herein are possible and are within the scope of the invention.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as "comprises," "includes," and "having" should be understood to provide support for narrower terms such as "consisting of," "consisting essentially of," and "comprised substantially of."

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the detailed description of the present invention. The disclosures of all patents, patent applications, and publications cited herein are hereby incorporated by reference.

What is claimed is:

1. A method for operating a natural gas liquids processing (NGL) system, the system being selectively configured in either an ethane rejection configuration or an ethane recovery configuration, the method comprising:

cooling a feed stream comprising methane, ethane, and propane in a heat exchanger to yield a chilled feed stream;

introducing the chilled feed stream into a separation vessel having a first portion, a second portion, and a third portion, wherein the chilled feed stream is introduced into the first portion of the separation vessel; and when the NGL system is in the ethane rejection configuration:

heating a bottom stream of the first portion in the heat exchanger to yield a heated bottom stream;

introducing the heated bottom stream into the second portion of the separation vessel;

introducing an overhead stream of the first portion into the third portion of the separation vessel;

introducing a bottom stream of the third portion into the second portion the separation vessel;

heating an overhead stream of the third portion in the heat exchanger, wherein in the ethane rejection configuration the overhead stream of the third portion comprises ethane in an amount of at least about 5% by volume;

introducing a bottom stream of the second portion into a reboiler; and collecting a reboiler bottom stream, wherein in the ethane rejection configuration the reboiler bottom stream comprises ethane in an amount of less than 5% by volume; and when the NGL system is in the ethane recovery configuration:

introducing the bottom stream of the first portion into the second portion of the separation vessel;

cooling the overhead stream of the first portion in the heat exchanger to yield a first chilled overhead stream;

introducing the first chilled overhead stream into the third portion of the separation vessel;

introducing the bottom stream of the third portion into the second portion of the separation vessel;

heating the overhead stream of the third portion in the heat exchanger, wherein in the ethane recovery configuration the overhead stream of the third portion comprises ethane in an amount of less than about 10% by volume;

introducing the bottom stream of the second portion into the reboiler; and collecting the reboiler bottom stream, wherein in the ethane recovery configuration the reboiler bottom stream comprises ethane in an amount of at least about 30% by volume, wherein the NGL system comprises a first valve, a second valve, a third valve, a fourth valve, a fifth valve, a sixth valve, a seventh valve, and an eighth valve, wherein the first, second, third, fourth, fifth, sixth, seventh, and eighth valves allow particular routes of fluid communication and disallow particular routes of fluid communication so as to configure the NGL system in either the ethane rejection configuration or the ethane recovery configuration.

2. The method of claim 1, wherein the feed stream comprises from about 5 to about 12 gallons of ethane per thousand standard cubic feet of gas in the feed stream.

3. The method of claim 1, wherein the chilled feed stream has a temperature of from about −15° F. to about −45° F.

4. The method of claim 1, wherein the bottom stream of the first portion is directed, in the ethane rejection configuration, to the heat exchange or in the ethane recovery configuration, to the second portion of the separation vessel via the sixth valve, wherein directing the bottom stream of the first portion through the sixth valve causes a reduction in pressure of the bottom stream to the first portion.

5. The method of claim 1, wherein:

in the ethane rejection configuration, the fourth valve is open, the third valve is closed, and the overhead stream of the first portion is introduced into the third portion of the separation vessel via the fourth valve, and in the ethane recovery configuration, the third valve is open, the fourth valve is closed, and the overhead stream of the first portion is introduced into the heat exchanger via the third valve.

6. The method of claim 5, wherein directing the overhead stream of the first portion through the fourth valve causes a reduction in pressure of the overhead stream of the first portion.

7. The method of claim 1, wherein:

in the ethane rejection configuration, the seventh valve is closed and the eighth valve is open, and in the ethane recovery configuration, the seventh valve is open, the eighth valve is closed, and the first portion bottom stream is introduced into the second portion of the separation vessel via the seventh valve.

8. The method of claim 1, further comprising:

when the NGL system is in the ethane rejection configuration:

cooling an overhead stream of the second portion in the heat exchanger to yield a second chilled overhead stream; and introducing the second chilled overhead stream into the third portion of the separation vessel; and when the NGL system is in the ethane recovery configuration:

introducing the overhead stream of the second portion into the third portion of the separation vessel.

9. The method of claim 8, wherein:

in the ethane rejection configuration, the first valve is closed, the second valve is open, and the overhead stream of the second portion is introduced into the heat exchanger via the second valve, and in the ethane recovery configuration, the first valve is open, the second valve is closed, and the overhead stream of the second portion is introduced into the third portion of the separation vessel via the first valve.

10. The method of claim 8, wherein the second chilled overhead stream is introduced into the third portion of the separation vessel via the fifth valve, wherein directing the second chilled overhead stream through the fifth valve causes a reduction in pressure of the second chilled overhead stream.

11. The method of claim 1, further comprising, in both the ethane rejection configuration and the ethane recovery configuration, returning a reboiler overhead stream to the second portion of the separation vessel.

12. A natural gas processing (NGL) system, the NGL system being selectively configured in either an ethane rejection configuration or an ethane recovery configuration, the NGL system comprising:

a heat exchanger;

a separation vessel having a first portion, a second portion, and a third portion; and a reboiler, wherein the NGL system is configured to:

cool a feed stream comprising methane, ethane, and propane in the heat exchanger to yield a chilled feed stream;

introduce the chilled feed stream into the first portion of the separation vessel; and when the NGL system is in the ethane rejection configuration, the NGL system is further configured to:

heat a bottom stream of the first portion in the heat exchanger to yield a heated bottom stream;

introduce the heated bottom stream into the second portion of the separation vessel;

introduce an overhead stream of the first portion into the third portion of the separation vessel;

introduce a bottom stream of the third portion into the second portion of the separation vessel;

heat an overhead stream of the third portion in the heat exchanger, wherein in the ethane rejection configuration the third portion overhead stream comprises ethane in an amount of at least 5% by volume;

introduce a bottom stream of the second portion into the reboiler; and collect a reboiler bottom stream, wherein in the ethane rejection configuration the reboiler bottom stream comprises ethane in an amount of less than 5% by volume; and when the NGL system is in the ethane recovery configuration, the NGL system is further configured to:

introduce the bottom stream of the first portion into the second portion of the separation vessel;

cool the overhead stream of the first portion in the heat exchanger to yield a first chilled overhead stream;

introduce the first chilled overhead stream into the third portion of the separation vessel;

introduce the bottom stream of the third portion into the second portion the separation vessel;

heat the overhead stream of the third portion in the heat exchanger, wherein in the ethane recovery configuration the third portion overhead stream comprises ethane in an amount of less than 10% by volume;

introduce the bottom stream of the second portion into the reboiler; and collect the reboiler bottom stream, wherein in the ethane recovery configuration the reboiler bottom stream comprises ethane in an amount of at least 30% by volume, wherein the NGL system further comprises a first valve, a second valve, a third valve, a fourth valve, a fifth valve, a sixth valve, a seventh valve, and an eighth valve, wherein the first, second, third, fourth, fifth, sixth, seventh, and eighth valves allow particular routes of fluid communication and to disallow particular routes of fluid communication so as to configure the NGL system in either the ethane rejection configuration or the ethane recovery configuration.

13. The system of claim 12, wherein the NGL system is further configured such that the bottom stream of the first portion is directed, in the ethane rejection configuration, to the heat exchanger or, in the ethane recovery configuration, to the second portion of the separation vessel via the sixth valve, wherein directing the bottom stream of the first portion through the sixth valve causes a reduction in pressure of the bottom stream of the first portion.

14. The system of claim 12, wherein the NGL system is further configured such that:

in the ethane rejection configuration, the fourth valve is open, the third valve is closed, and the overhead stream of the first portion is introduced into the third portion of the separation vessel via the fourth valve, and in the ethane recovery configuration, the third valve is open, the fourth valve is closed, and the overhead stream of the first portion is introduced into the heat exchanger via the third valve.

15. The system of claim 14, wherein the NGL system is further configured such that directing the overhead stream of the first portion through the fourth valve causes a reduction in pressure of the overhead stream of the first portion.

16. The system of claim 12, wherein the NGL system is further configured such that:

in the ethane rejection configuration, the seventh valve is closed and the eighth valve is open, and in the ethane recovery configuration, the seventh valve is open, the eighth valve is closed, and the bottom stream of the first portion is introduced into the second portion of the separation vessel via the seventh valve.

17. The system of claim 12, wherein:

when the NGL system is in the ethane rejection configuration, the NGL system is further configured to:

cool an overhead stream of the second portion in the heat exchanger to yield a second chilled overhead stream; and introduce the second chilled overhead stream into the third portion of the separation vessel; and when the NGL system is in the ethane recovery configuration, the NGL system is further configured to:

introduce the overhead stream of the second portion to the third portion of the separation vessel.

18. The system of claim 17, wherein the NGL system is further configured such that:

in the ethane rejection configuration, the first valve is closed, the second valve is open, and the overhead stream of the second portion is introduced into the heat exchanger via the second valve, and in the ethane recovery configuration, the first valve is open, the second valve is closed, and the overhead stream of the second portion is introduced into the third portion of the separation vessel via the first valve.

19. The system of claim 17, wherein the NGL system is further configured such that the second chilled overhead stream is introduced into the third portion of the separation vessel via the fifth valve, wherein directing the second chilled overhead stream through the fifth valve causes a reduction in pressure of the second chilled overhead stream.

20. The system of claim 12, wherein in both the ethane rejection configuration and the ethane recovery configuration, the NGL system is further configured to return a reboiler overhead stream to the second portion of the separation vessel.

21. A method for processing gas, comprising:

feeding a feed gas stream comprising methane, ethane, and C3+ compounds to an integrated separation column, wherein the integrated separation column is selectably configurable between an ethane rejection configuration and an ethane recovery configuration;

operating the integrated separation column in the ethane rejection configuration, wherein the feed gas stream is cooled and subsequently flashed in a bottom isolated portion of the integrated separation column to form a flash vapor, wherein the flash vapor is reduced pressure and subsequently fed as a vapor to an upper isolated portion of the integrated separation column; wherein an overhead stream from an intermediate isolated portion of the integrated separation column is cooled and fed as a liquid to the upper isolated portion of the integrated separation column;

recovering an overhead residual gas stream comprising methane and ethane from the integrated separation column, wherein the overhead residual gas stream comprises equal to or greater than 40 volume percent of the ethane in the feed gas stream;

recovering a bottom natural gas liquid (NGL ) product stream comprising ethane and C3+ compounds from the integrated separation column;

discontinuing operation of the integrated separation column in the ethane rejection configuration;

reconfiguring the integrated separation column from the ethane rejection configuration to the ethane recovery configuration;

operating the integrated separation column in the ethane rejection configuration, wherein the feed gas stream is cooled and subsequently flashed in the bottom isolated portion of the integrated separation column to form the flash vapor, wherein the flash vapor is cooled and subsequently fed as a liquid to an upper isolated portion of the integrated separation column;

wherein the overhead stream from the intermediate isolated portion of the integrated separation column is fed as the vapor to the upper isolated portion of the integrated separation column;

recovering the overhead residual gas stream comprising methane and ethane from the integrated separation column; and recovering the bottom natural gas liquid (NGL) product stream comprising ethane and C3+ compounds from the integrated separation column, wherein the overhead residual gas stream comprises equal to or greater than 95 volume percent o f the ethane in the feed gas stream.

* * * * *